US006840851B1

(12) United States Patent
Raffaelli

(10) Patent No.: US 6,840,851 B1
(45) Date of Patent: Jan. 11, 2005

(54) BEVEL EDGING WHEEL WITH SWARF CLEARANCE

(75) Inventor: Dennis R. Raffaelli, Oxford, MI (US)

(73) Assignee: Inland Diamond Products Company, Madison Heights, MI (US)

( * ) Notice: Subject to any disclaimer, the term of this patent is extended or adjusted under 35 U.S.C. 154(b) by 19 days.

(21) Appl. No.: 09/672,917

(22) Filed: Sep. 28, 2000

(51) Int. Cl.[7] ..... B24D 5/02
(52) U.S. Cl. ..... 451/547; 51/356; 451/541
(58) Field of Search ..... 451/547, 541; 125/15, 18; 51/206 R, 206 P, 206.4, 206.5, 206 NF, 204, 356, 392

(56) References Cited

U.S. PATENT DOCUMENTS 888,129 A * 5/1908 Tone ..... 51/293
909,913 A * 1/1909 Landis ..... 451/547
2,755,601 A * 7/1956 Lux ..... 451/178
3,711,999 A * 1/1973 Held
3,916,579 A * 11/1975 Waller et al. ..... 451/547
4,931,069 A 6/1990 Wiand
4,940,039 A * 7/1990 Buettner ..... 125/15
4,978,254 A * 12/1990 Langlois et al. ..... 407/33
5,052,154 A * 10/1991 Lehmann ..... 451/542
5,655,958 A * 8/1997 Lupi
5,997,597 A * 12/1999 Hagan
6,110,027 A * 8/2000 Muller

* cited by examiner

*Primary Examiner*—Lee D. Wilson
*Assistant Examiner*—Anthony Ojini
(74) *Attorney, Agent, or Firm*—Warn, Hoffmann, Miller & LaLone, P.C.

(57) ABSTRACT

A bevel edge wheel having a swarf clearance slot across the shaping face. The slot reduces the amount of hand removal of swarf from a processed lens blank.

17 Claims, 2 Drawing Sheets

BEVEL EDGING WHEEL WITH SWARF CLEARANCE

TECHNICAL FIELD

The present invention relates to a bevel edging wheel of the type used for edging of an optical edge. More specifically, the present invention relates to a bevel edging wheel which reduces the necessary manual removal of swarf from the lens after edging of an optical lens.

BACKGROUND OF THE INVENTION

Optical lenses made of polycarbonates, high index and CR39 materials are known in the art. In order to finish and make these lenses ready for fitting into a lens frame, it is necessary to bevel edge the outer periphery of the lens, to give it the proper cross-section to fit in an eye glass lens frame. Typically, this is done by a bevel edging machine, which includes a rough cut wheel for cutting out the shape and a bevel edging wheel for providing the final contour. Depending on the lens material, the grinding operation creates abrasive swarf material which requires removal in order for proper use of any type of abrasive device. Typically, the wheels have build up of swarf during the operation, which imparts itself onto the lens. This creates the need to manually remove the swarf from the lens. Any swarf which is not readily removed during the grinding of the bevel edging operation, interferes with the operation and, at the very least, slows it down and may add to several hand finishing steps necessary at the end, or an improper bevel configuration.

In the optical industry today, the one hour optical labs and the like have made it necessary for increased any improved efficiencies are desirable in the process. Therefore, it is desired to eliminate swarf removal on the polycarbonate lens by hand, which is labor intensive and time consuming.

Therefore, it is a goal in the art to provide a bevel edging wheel which eliminates the need for manual swarf removal.

SUMMARY OF THE INVENTION

In accordance with the present invention, there is provided a bevel ending wheel for edge finishing of an optical lens blank. The lens comprises a hub portion which is adapted for attachment to a rotary power source. The wheel includes an outer circumferential cutting surface having a width. The outer circumferential cutting surface includes an abrasive grit attached thereto and also has a circumferential groove therein for forming an edge contour onto an optical lens. The wheel includes a radially extending planar side portion, and in a preferred embodiment, has at least one swarf clearing groove extending at an angle to said side portion across the circumferential groove and opening into the planar side portion, which allows removal of swarf out through the planar side portion.

A further understanding of the present invention will be had in view of the description of the drawings and detailed description of the invention, when viewed in conjunction with the subjoined claims.

DETAILED DESCRIPTION OF THE PREFERRED EMBODIMENTS

In accordance with the present invention, there is provided a rotary edging wheel generally shown at 10 for edge finishing of an optical lens. The bevel edge wheel of the present invention includes a hub portion generally indicated at 12 and an outer circumferential cutting surface generally indicated at 14.

Figure 1:
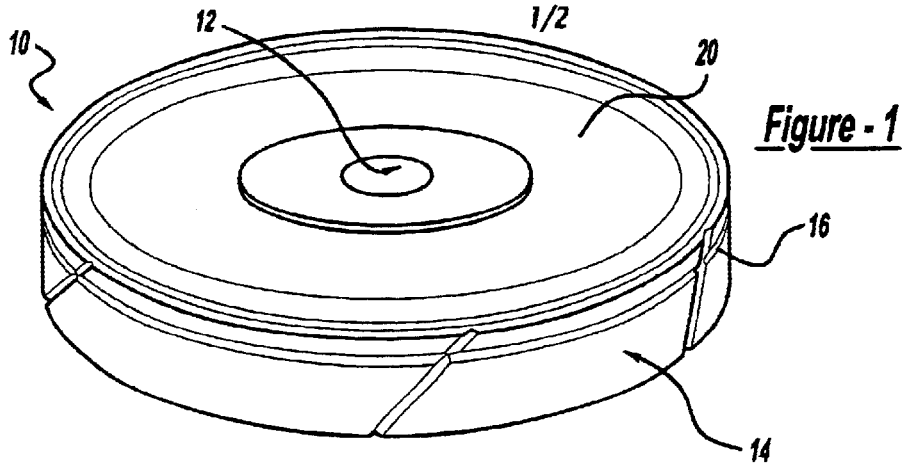
FIG. 1 is a perspective view of the bevel edging wheel of the present invention.
Figure 2:
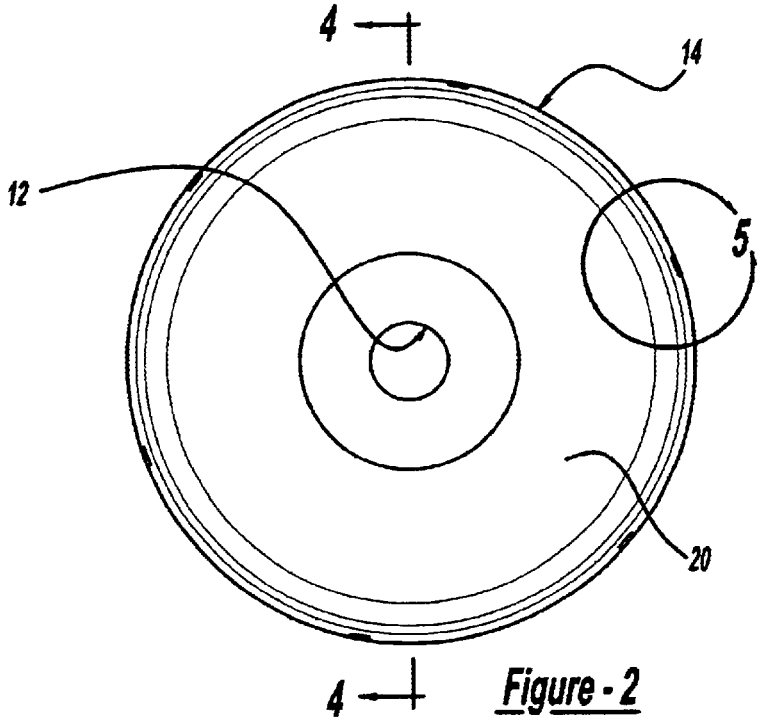
FIG. 2 is a plan view of the bevel edging wheel of the present invention.
Figure 3:
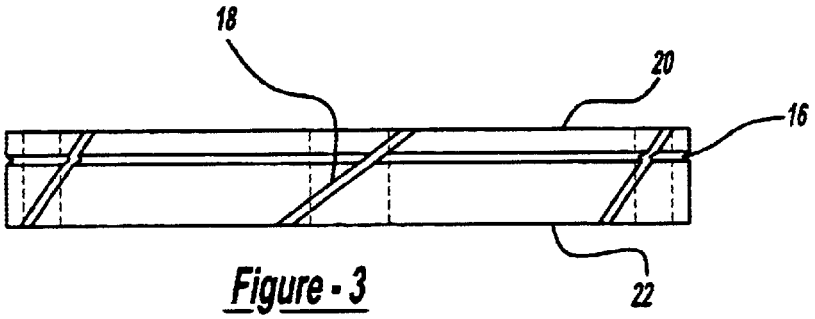
FIG. 3 is a top view of the bevel edging wheel of the present invention.
Figure 4:
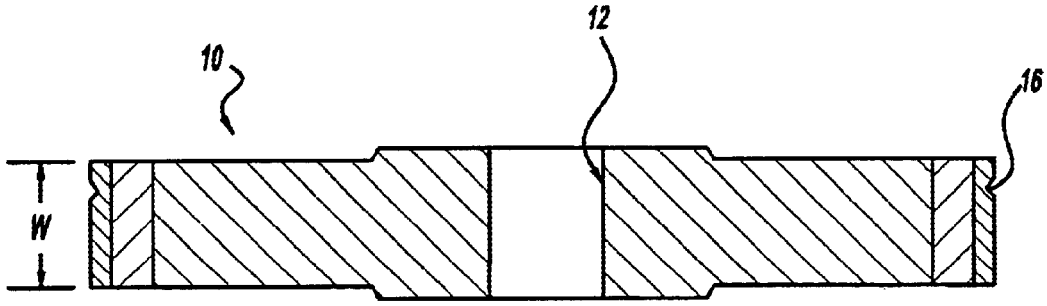
FIG. 4 is a sectional side view taken along line 4—4 of FIG. 2.

Referring now to FIGS. 2–4, an outer circumferential cutting surface includes a width W and has a circumferential groove 16 formed therein. Abrasive grit material is attached to the outer surface 14 and within the groove 16 for cutting of the lens. The wheel of the present invention includes at least one swarf clearing groove 18 which extends at least through the groove 16 to an outer planar surface of the wheel 20 or 22. The swarf clearing groove extends to the outer planar surface for removal or swarf during cutting of the lens.

In a preferred embodiment, the angle of the swarf clearing groove 18 may be 40 degrees from a side wall. Generally, the groove would be angled from about 10 degrees to about 80 degrees in relation to the side wall 20. Typically, the groove is formed at an angle of about 15 degrees to about 65 degrees, and preferably from about 35 degrees to about 45 degrees. In a preferred embodiment, the groove extends along the entire width of the wheel W. However, it will be readily appreciated that it is only necessary to run the groove from the bevel edge forming portion of the wheel to the exterior of the wheel, such that swarf can be removed along the groove.

Figure 5:
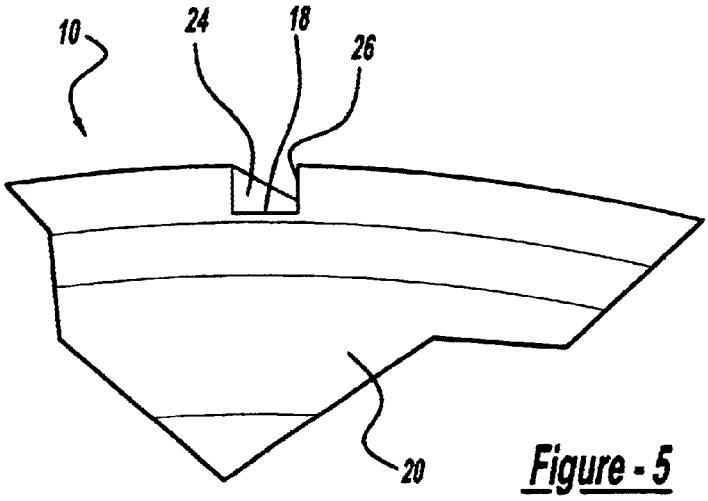
FIG. 5 is a detailed side view showing the swarf clearing groove of the present invention.

Referring to FIG. 5, the groove 18 has planar sides 24 and 26 which extend perpendicular to outer surface 14. In a preferred embodiment, a ⅛" wide and 0.060" deep slot is formed in the wheel, generally from 20 degrees to 80 degrees slot angles, and preferably 40 degrees to 70 degrees, with 60 degrees preferred. While at least one of the slots is necessary, preferably a plurality of slots is utilized which are equiangular spaced around the outer periphery. Generally, from greater than 1 to about 20 slots are used, and preferably 4 to about 8, with 6 being preferred.

Bevel edging wheels made in accordance with the present invention are readily used in bevel edging machines such as those made by Weco, Colburn or the like. Such machines are readily known to those skilled in the art, as well as their operation. While bevel grooves are disclosed, the wheel of the present invention can be used without a bevel groove such as in a rimless flat style wheel.

The cross-section of the beveling groove may be any of the desirable cross-sections for use of the lens in a glass frame of those known in the art. Typically, it is an angled section of about 105 degrees, as shown in the drawings. However, other configurations may be readily adapted to the present invention. Typically, the abrasive grits used in the present invention are from about 5–10 microns to about 100–120 microns. Preferably, the grits are attached by brazing the abrasive grit onto the wheel. However, the grit surface may also be attached by sintering electroplating or resin bonding, with a preferred abrasive grit material being a diamond-like hardness abrasive grit. However, other materials such as silicon carbides, tungsten carbides, oxides, garnets, cubic boron nitride, and natural and synthetic diamonds may be used alone or in combination in the present invention. It has been found that the wheel of the present invention eliminates about 90 percent of the swarf from the edge of polycarbonate, high index and CR39 lens materials.

Those skilled in the art can now appreciate from the foregoing description that the broad teachings of the present invention can be implemented in a variety of forms. Therefore, while this invention has been described in connection with particular examples thereof, the true scope of the invention should not be so limited, since other modifications will become apparent to the skilled practitioner upon a study of the drawings, specification and following claims.

What is claimed is:

1. A rotary edging wheel comprising:

a hub portion adapted for attachment to a rotary power source;

an outer circumferential cutting surface having a width, said surface including an abrasive grit attached thereto, wherein said surface is substantially planar;

a radially extending planar side portion; and at least one swarf clearing groove extending at an angle across the entire width of said surface and opening into said planar side portion, said swarf clearing groove operable to remove swarf out through said planar side portion;

wherein said surface is operable for edge finishing of an optical lens.

2. The bevel edging wheel of claim 1 further comprising a plurality of swarf clearing grooves formed in said cutting surface.

3. The bevel edging wheel of claim 1 wherein said swarf clearing groove has an angle of from about 10 degrees to about 80 degrees.

4. The bevel edging wheel of claim 1 wherein said swarf clearing groove has an angle of from about 15 degrees to about 65 degrees.

5. The bevel edging wheel of claim 1 wherein said swarf clearing groove has an angle of from about 35 degrees to about 45 degrees.

6. The bevel edging wheel of claim 1 wherein the abrasive grit is attached to the wheel by a method selected from the group consisting of brazing, electroplating, sintering, resin bonding, and combinations thereof.

7. The bevel edging wheel of claim 6 wherein said abrasive grit is a diamond hardness grit.

8. A rotary edging wheel comprising:

a hub portion adapted for attachment to a rotary power source;

an outer circumferential cutting surface having a width, said surface including an abrasive grit attached thereto, and having a circumferential groove therein for forming an edge contour onto an optical lens, wherein said surface is substantially planar;

a radially extending planar side portion; and a plurality of swarf clearing grooves extending at an angle across the entire width of said surface and opening into said planar side portion, said swarf clearing grooves operable to remove swarf out through said planar side portion;

wherein said surface is operable for edge finishing of an optical lens.

9. The bevel edging wheel of claim 8 wherein said swarf clearing groove has an angle of from about 10 degrees to about 80 degrees.

10. The bevel edging wheel of claim 8 wherein said swarf clearing groove has an angle of from about 15 degrees to about 65 degrees.

11. The bevel edging wheel of claim 8 wherein said swarf clearing groove has an angle of from about 35 degrees to about 45 degrees.

12. The bevel edging wheel of claim 8 wherein the abrasive grit is attached to the wheel by a method selected from the group consisting of brazing, electroplating, sintering, resin bonding, and combinations thereof.

13. The bevel edging wheel of claim 12 wherein said abrasive grit is a diamond hardness grit.

14. A rotary bevel edging wheel comprising:

a hub portion adapted for attachment to a rotary power source;

an outer circumferential cutting surface having a width, said surface including an abrasive grit attached thereto, and having a circumferential groove therein for forming an edge contour onto an optical lens, wherein said surface is substantially planar;

a radially extending planar side portion; and a plurality of swarf clearing grooves extending across the entire width of said outer circumferential cutting surface, at an angle of from about 35 to about 45 degrees to said planar side portion and opening into said planar side portion, said swarf clearing grooves operable to remove swarf out through said planar side portion;

wherein said surface is operable for edge finishing of an optical lens.

15. The bevel edging wheel of claim 14 wherein the abrasive grit is attached to the wheel by a method selected from the group consisting of brazing, electroplating, sintering, resin bonding, and combinations thereof.

16. The bevel edging wheel of claim 15 wherein said abrasive grit is a diamond hardness abrasive grit.

17. The bevel edging wheel of claim 14, wherein said abrasive grit is a diamond grit material having a mesh of from about 5–10 microns to about 100–120 mesh.

* * * * *

UNITED STATES PATENT AND TRADEMARK OFFICE

CERTIFICATE OF CORRECTION

PATENT NO. : 6,840,851 B1
APPLICATION NO. : 09/672917
DATED : January 11, 2005
INVENTOR(S) : Dennis R. Raffaelli It is certified that error appears in the above-identified patent and that said Letters Patent is hereby corrected as shown below:

Column 1,
Line 33, “any” should be -- and --.

Column 4,
Line 50, Claim 17, “mesh” should be -- microns --.

Signed and Sealed this

Fifteenth Day of August, 2006

JON W. DUDAS
*Director of the United States Patent and Trademark Office*